United States Patent [19]

Lemler

[11] 4,008,742

[45] Feb. 22, 1977

[54] FLEXIBLE RECEPTACLE WITH CREDIT CARD HOLDER

[75] Inventor: Paul L. Lemler, West Bend, Wis.

[73] Assignee: Amity Leather Products Company, West Bend, Wis.

[22] Filed: Mar. 24, 1976

[21] Appl. No.: 669,875

[52] U.S. Cl. ..... 150/35; 150/39; 40/124.2

[51] Int. Cl.² ..... A45C 1/06

[58] Field of Search ..... 150/35, 38, 39; 40/124.2, 124.4, 124

[56] References Cited

UNITED STATES PATENTS

| | | | |
|---|---|---|---|
| 837,481 | 12/1906 | Leuthesser | 40/124.4 |
| 2,959,879 | 11/1960 | Mazur | 40/124.4 X |
| 3,073,050 | 1/1963 | Dubois | 40/124.4 |
| 3,856,063 | 12/1974 | Dengel | 40/124.4 X |

FOREIGN PATENTS OR APPLICATIONS

| | | | |
|---|---|---|---|
| 2,354,698 | 5/1974 | Germany | 150/39 |

*Primary Examiner*—Donald F. Norton
*Attorney, Agent, or Firm*—James E. Nilles

[57] ABSTRACT

A credit card holder for use in a billfold, wallet or similar items and for holding a series of credit cards in shingled, overlapping relationship. The credit card holder includes an outer flexible wall member having a series of generally parallel slits therein and spaced apart such that the wall member includes a plurality of parallel adjacent strips. An inner flexible liner comprised of a generally rectangular single sheet of flexible material is received in back-to-back relationship against the rear surface of the outer flexible wall and the peripheries of the flexible liner and outer wall are bonded together. The inner flexible liner includes a plurality of three-sided slits which are formed in adjacent but spaced relationship so as to define a series of nested flexible flaps. The flexible flaps each have an upper edge which can be secured to the rear surface on one of the strips. Thus, when a credit card is received through the slits in the outer flexible wall, it can be received between the flexible flaps and flexible liner and be supported by the juncture of the flaps and the flexible liner.

3 Claims, 6 Drawing Figures

FLEXIBLE RECEPTACLE WITH CREDIT CARD HOLDER

BACKGROUND OF THE INVENTION

The present invention relates to billfolds, wallets and the like, and more particularly to credit card holders for use in billfolds or wallets and for providing a plurality of compartments for receiving credit cards or similar items in stacked shingled relationship.

Billfolds and wallets including means for receiving credit cards are shown, for example, in U.S. Pat. No. 3,856,063, issued to Dengel Dec. 17, 1974 and assigned to an assignee in common with that of the present invention.

SUMMARY OF THE INVENTION

The present invention provides an improved credit card holder which can be used in a billfold, wallet or other similar item and which provides a means to minimize the thickness of the wallet while providing a method for supporting a large number of credit cards in stacked shingled relationship. The credit card holder also facilitates a more economical mode of manufacture conserving both material and assembly time.

Generally, the credit card holder of the invention comprises an outer flexible sheet member or wall having a series of generally parallel slits therein which are spaced apart such that the outer wall includes a plurality of laterally extending parallel adjacent strips. The credit card holder also includes an inner flexible liner comprised of a generally rectangular sheet of flexible material and is received in back-to-back relationship against the rear surface of the outer flexible wall. The peripheries of the flexible liner and the outer flexible wall are bonded together to secure these members in back-to-back relation. The inner flexible liner includes a plurality of three-sided slits which are formed in adjacent but spaced relationship so as to define a series of aligned and similarly shaped nested flexible flaps. The flexible flaps each include an upper edge which can be secured to the rear surface of one of the strips of the outer flexible wall in such a manner that when a credit card is received through the slits in the outer flexible wall, the credit card is received between the flexible flap and the flexible liner and is supported along its bottom edge by the juncture of the flexible flap and the flexible liner.

In manufacturing billfolds or wallets, it is generally desirable to construct these items to comprise the thinnest possible unit. The prior art has illustrated means for supporting credit cards in stacked shingled relationship but these prior art means required the use of a plurality of stacked pockets which each included several layers of flexible material. Since the pockets were in stacked relationship, this means of supporting the credit cards required an accumulation of a large number of layers of material. An advantage of the present invention, on the other hand, lies in the fact that no more than two layers of material, i.e., the front flexible wall and the flexible liner, are required to support the credit cards. This effectively reduces the thickness of the credit card holder. It is also desirable during manufacturing to produce the credit card holder using the least amount of material and using the fewest number of assembly steps and the least amount of manufacturing time. The prior art methods generally required an assembly process wherein the various sheets comprising the pockets were either folded or otherwise formed and then secured in some manner by stitching, heat sealing or otherwise securing them to a backing sheet. The present invention uses a single sheet and requires only a single step in order to cut the necessary slits into the flexible liner to form the flexible flaps.

These and other advantages of the invention will become clear with reference to the drawings and the description of a preferred embodiment which follows. The drawings illustrate only one embodiment of the credit card holder of the invention but it should be clear other modifications of the credit card holder shown and described are within the scope of the invention and that the credit card holder can be used with any type of billfold, wallet or similar article and is not restricted to use with the type of billfold shown in the drawings.

DESCRIPTION OF THE PREFERRED EMBODIMENT

Figure 1:
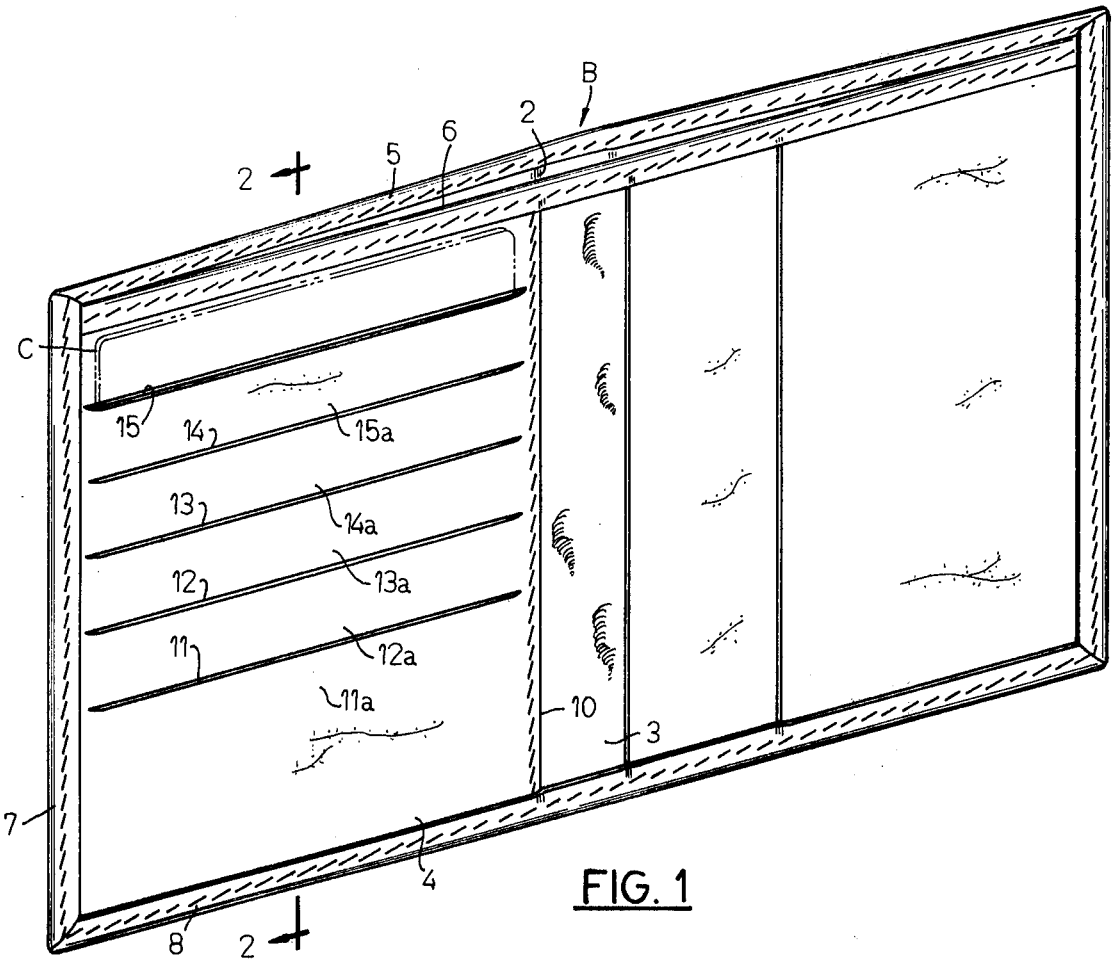
FIG. 1 is a perspective view of a billfold embodying the credit card holder of the present invention, the view being taken generally from the inside of the wallet.
Figure 3:
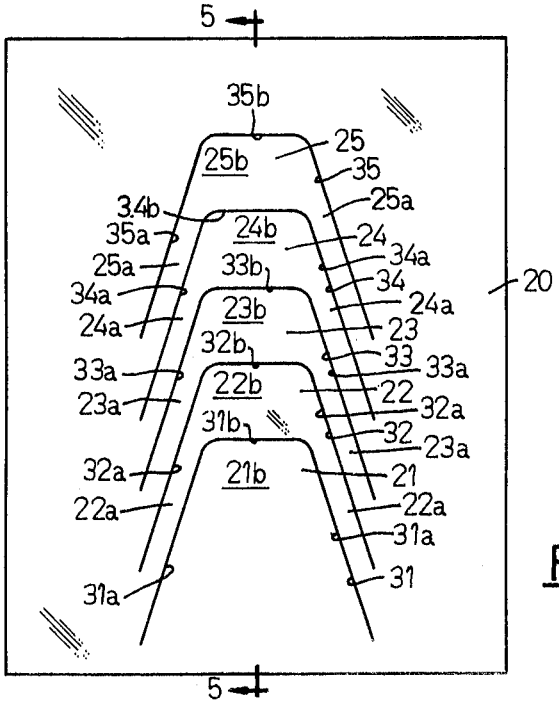
FIG. 3 is a front view of the flexible liner made in accordance with the present invention and as employed in the billfold of FIGS. 1 and 2.
Figure 5:
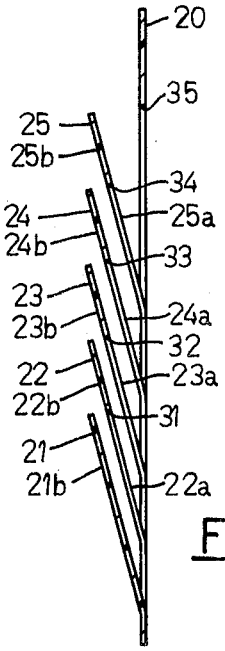
FIG. 5 is a cross-sectional view taken along line 5—5 in FIG. 3 but showing the flexible flaps of the flexible liner pulled forwardly.
Figure 4:
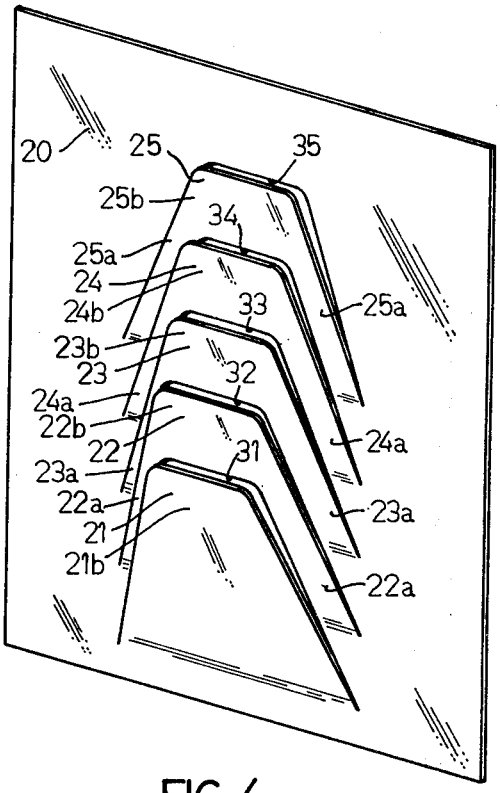
FIG. 4 is a perspective view of the flexible liner shown in FIG. 3.
Figure 2:
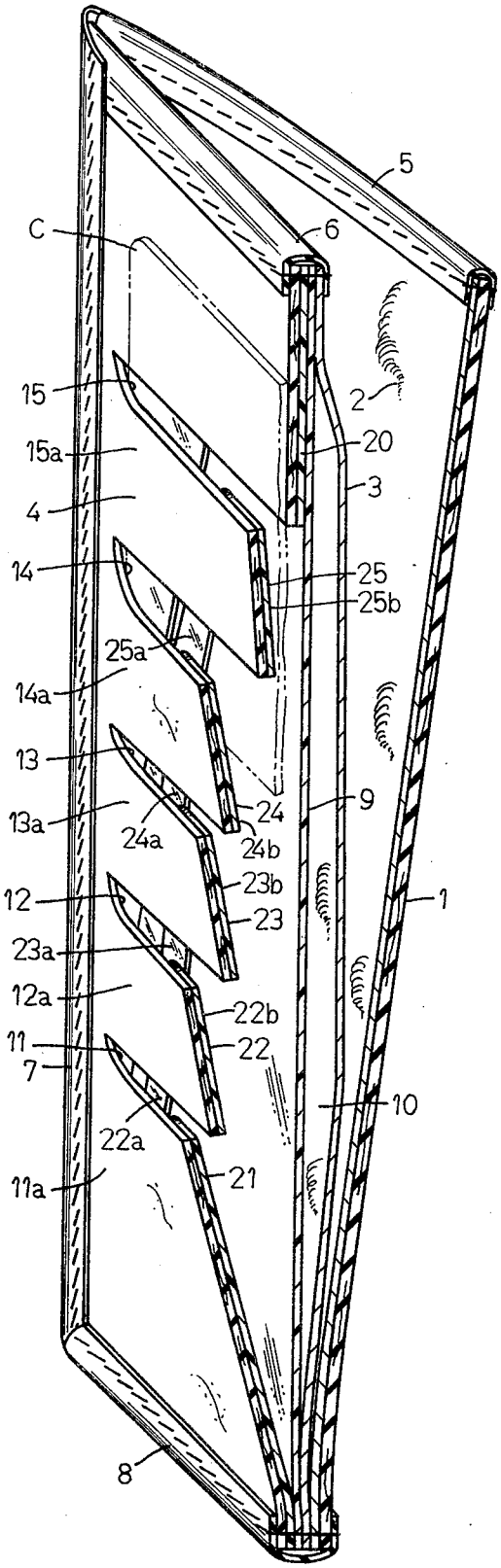
FIG. 2 is a sectional view taken generally along the line 2—2 in FIG. 1, but on an enlarged scale and being exaggerated in that the individual pockets are pulled outwardly to show their construction.

The credit card holder of the invention is shown in FIGS. 1 and 2 as being embodied in a wallet or billfold B which is made generally from leather, for example, and comprises an outside wall 1 lined with fabric 2, an inner flexible wall 3, which may be formed of fabric, and an outer or front flexible sheet or wall 4, also formed of a material such as leather. The usual edging and stitching 5 is provided around the periphery of the billfold B. More specifically, the edging 5 binds the wall 1 and its lining 2 together and also binds together the inner flexible wall 3 and the front flexible wall 4.

The inner flexible wall 3 and the front flexible wall 4 are secured together by edging and stitching around the upper side 6, the vertical side 7 and the lower side 8, thus presenting an envelope-like opening 10 along its other vertical side, and more specifically, between the walls 3 and 4. This envelope-like opening 10 is provided to receive flat objects such as papers and the like.

The front flexible wall 4 includes a plurality of horizontally or transversely extending slits 11, 12, 13, 14, and 15 formed therein and arranged in parallel relationship with one another, and also being spaced a vertical distance apart, generally on the order of one-half inch, thereby forming a plurality of laterally extending strips 11*a*, 12*a*, 13*a*, 14*a*, and 15*a* in the front flexible wall 4. These slits 11–15 are provided to receive credit cards which can be inserted into the slits at least partially so as to extend upwardly therefrom and so as to be positioned in overlapping shingled relationship with one another.

Heretofore, in order to hold credit cards properly within the slits, a series of individual stacked pockets were used, one pocket being aligned with each of the parallel slits and for supporting one credit card therein. This resulted in the use of a large number of layers of flexible material to form the plurality of pockets, these layers of flexible material being arranged in stacked relationship and thus adding to the overall thickness of the wallet or billfold. The individual pockets were also relatively difficult to assemble and manufacture due to the number of pieces of flexible material required and due to the necessity that they each be bonded together in some manner.

In accordance with the present invention, a thin one-piece flexible liner 20 can be received within the envelope 10, defined by the front flexible wall 4 and the inner flexible wall 3. The one-piece flexible liner 20 includes a plurality of flexible flaps 21, 22, 23, 24, and 25 which can be respectively secured to the front flexible wall 4 in such a manner that the slits 11–15 and the flaps 21–25 function in combination to provide pockets for supporting credit cards in stacked shingled relationship as will be further described.

The structure of the one-piece flexible liner 20 is best shown in the FIGS. 3–6 and as being comprised of a thin sheet of flexible material, for example, transparent semi-rigid vinyl. The flexible liner 20 includes a plurality of spaced generally curvilinear cuts or slits 31, 32, 33, 34, and 35 which respectively define the flexible flaps 21–25. Each of the curvilinear slits 31–35 includes a pair of spaced generally linear longitudinally extending slits **31*a*–35*a* which converge toward their upper ends where they are joined by transversely extending slits 31*b*–35*b*, respectively, which form the upper edges of the respective flexible flaps defined by the slits. It should be noted that the slits 31–35 define a plurality of longitudinally aligned nested flexible flaps which are each joined to the flexible liner 20 at opposite sides of their base portions and which include upper portions flexibly movable away from the plane of the liner 20. It should also be noted that the flexible flaps 22–25 formed by the slits 31*a*–35*a* are each defined by a pair of generally longitudinally extending strips 22*a*–25*a*, respectively, which tend to converge toward their upper ends and which are joined at their upper ends by a transversely extending end portion 22*b*–25*b*, respectively. When the flexible flaps 21–25 are positioned in planar relationship with the flexible liner 20,** the adjacent flexible flaps are received one inside the other in nested relationship, i.e., with the lower flexible flaps received between and adjacent to the longitudinal strips of the flexible flap immediately above.

Figure 6:
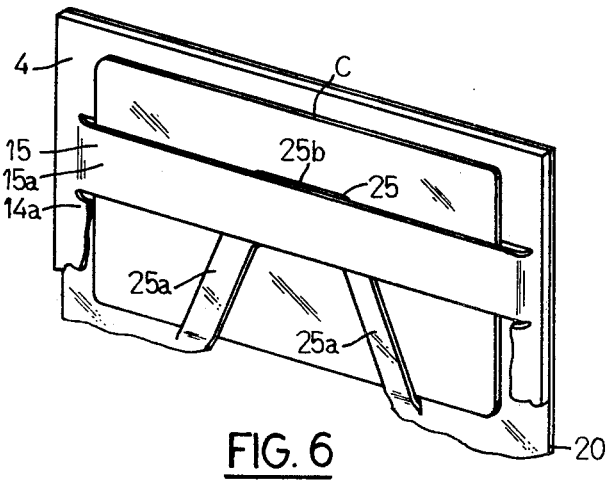
FIG. 6 is a partial perspective view of the credit card holder shown in FIG. 1 and shown supporting a credit card, certain portions of the credit card holder being broken away in the interest of clarity.

As shown in FIG. 2, the flexible liner 20 is positioned within the envelope 10 with the peripheral edges of three sides of the liner 20 being secured to the front flexible wall 4 by the edging and stitching 5. The transversely extending slits **31*b*–35*b* of each of the slits 31–35 are spaced apart by a distance which is substantially equal to the spacings between the slits 11–15 in the front flexible wall 4. Therefore, when the flexible liner 20 is received in the envelope 10 and against the rear surface of the front flexible wall 4, the slits 11–15 will be respectively aligned with the upper edges of the flexible flaps 21–25. The upper end portions 21*b*–25*b* of each of the flexible flaps 21–25 are secured to the rear surfaces of the respective adjacent laterally extending strips 11*a*–15*a* of the front flexible wall 4 defined by the slits 11–15. These upper end portions 21*b*–25*b*** of the flexible flaps can be secured to the strips in any convenient manner, such as by adhesive or stitching.

when a credit card C is to be received within any of the slits 11–15, the credit card will be received through the slit and behind the adjacent flexible flap so as to be supported between that flexible flap and the flexible liner in a manner as shown in FIG. 6. It will be noted that the lower edge of the card C is supported by the juncture between the flexible flap and the flexible liner and the opposite sides of the card C are held in position by the ends of the slit 15 in the front flexible wall 4.

A flexible backing sheet 9 may also be provided behind and adjacent to the flexible liner 20.

Though the flexible liner 20 has been described as being constructed from a transparent plastic or vinyl material, it is also feasible to construct the flexible wall from any other flexible material which is resistant to being torn. Appropriate materials also include leather, fabric, or tear-resistant paper. As an alternative example to the embodiment shown in the drawings, the front flexible wall and the flexible liner could be constructed from a single piece of leather or flexible plastic and folded to form the front flexible wall 4 and the flexible liner 20 received in adjacent back-to-back relationship, having the appropriate slits 11–15 and 31–35 as previously described and bonded together at the appropriate positions as also previously described. As a corollary, the front flexible wall 4, which has been described as being comprised of leather, could also be constructed from a thin transparent semi-rigid vinyl.

Though the particular embodiment of the invention illustrates a billfold B, which includes a credit card holder having horizontally extending slits 11–15 in the front flexible wall 4 for receiving credit cards therein, it should be readily apparent that the billfold could also have vertically extending slots. Furthermore, though the invention is shown as being embodied in a billfold, the credit card holder of the invention would be equally adapted and useful in any similar personal item which could be used for carrying credit cards, such as a check book holder, French purse, or clutch purse.

I claim:

1. A flexible receptacle including a credit card holder for holding a series of credit cards in shingled, overlapping relationship, said credit card holder comprising an outer flexible wall securable to said flexible receptacle and having a series of generally parallel slits which form individual strips in said outer flexible wall, an inner flexible liner comprising a single flexible sheet of single thickness having a periphery and having a plurality of similarly shaped slits therethrough, means for securing said periphery to said outer flexible liner, said slits each including spaced apart side slits and an upper slit joining the spaced apart side slits, so as to form a series of similarly shaped nested flaps each having a free upper edge which can be displaced from the plane of said flexible sheet and said nested flaps each being connected to said flexible sheet at opposite sides, and said flexible sheet being aligned with said outer flexible wall so that said flaps of said liner are located adjacent to said strips in said outer flexible wall, the upper edge of each of said flaps being aligned with one of said parallel slits in said outer flexible wall and whereby individual pockets are formed between said outer flexible wall and said liner to receive credit cards through said parallel slits in said outer flexible wall for resting between said flaps and said liner and for arrangement in shingled overlapping relationship, and means for securing said flaps to said outer flexible wall.

2. The flexible receptacle set forth in claim 1 wherein said flaps are centrally secured to said strips.

3. The flexible receptacle set forth in claim 1 wherein said flaps each include spaced converging generally longitudinal strips, said longitudinal strips being connected at one end by a transversely extending flap portion and connected at their other ends to said liner.

* * * * *